US010857412B2

(12) United States Patent
Auguste

(10) Patent No.: US 10,857,412 B2
(45) Date of Patent: Dec. 8, 2020

(54) WEIGHTED WRIST BAND ASSEMBLY

(71) Applicant: Maurepaz Auguste, Guttenberg, NJ (US)

(72) Inventor: Maurepaz Auguste, Guttenberg, NJ (US)

( * ) Notice: Subject to any disclaimer, the term of this patent is extended or adjusted under 35 U.S.C. 154(b) by 35 days.

(21) Appl. No.: 16/167,659

(22) Filed: Oct. 23, 2018

(65) Prior Publication Data

US 2020/0121972 A1 Apr. 23, 2020

(51) Int. Cl.
*A63B 21/065* (2006.01)
*A63B 21/00* (2006.01)

(52) U.S. Cl.
CPC ..... *A63B 21/065* (2013.01); *A63B 21/4021* (2015.10); *A63B 21/4025* (2015.10); *A63B 2244/102* (2013.01)

(58) Field of Classification Search
CPC ..... A63B 21/065; A63B 21/4021; A63B 2244/102; A63B 71/145; A63B 71/146; A63B 71/141; A63B 21/072
See application file for complete search history.

(56) References Cited

U.S. PATENT DOCUMENTS 3,536,068 A * 10/1970 Stubbs ..... A61F 5/3761 128/878
4,322,072 A * 3/1982 White ..... A63B 21/065 482/105
5,514,056 A * 5/1996 Ronca ..... A63B 21/0607 482/105
D418,559 S 1/2000 Cousins
6,168,556 B1 * 1/2001 Saavedra ..... A63B 21/4019 224/220
6,561,958 B2 5/2003 Pappert
6,687,916 B2 * 2/2004 Thompson ..... A44C 5/0007 2/16
7,090,624 B1 * 8/2006 Chrishon ..... A63B 21/0601 482/105
D611,715 S 3/2010 Werschmidt
8,182,429 B2 5/2012 Mason
8,876,667 B2 11/2014 Russotti
9,662,530 B2 * 5/2017 Dimitrov ..... A63B 21/0728
2013/0283498 A1 * 10/2013 Hewitt ..... A63B 71/141 2/161.1

* cited by examiner

*Primary Examiner* — Loan B Jimenez
*Assistant Examiner* — Andrew M Kobylarz

(57) ABSTRACT

A weighted wrist band assembly includes a band that is wearable around a cuff of a boxing glove when the boxing glove is worn for boxing training. A strap is coupled to the band and the strap is matable to the band such that the band and the strap form a closed loop around the cuff of the boxing glove. A grip is coupled to the band and the grip is unrestrained when the band and strap are worn around the boxing glove. Thus, a trainee can manipulate the grip when the trainee is wearing boxing gloves. A flexible weight is positioned within the band for increasing a weight of the boxing glove thereby enhancing strength training and endurance training when the boxing glove is worn.

7 Claims, 5 Drawing Sheets

WEIGHTED WRIST BAND ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98.

The disclosure and prior art relates to wrist band devices and more particularly pertains to a new wrist band device for tracking motion during athletic training.

BRIEF SUMMARY OF THE INVENTION

An embodiment of the disclosure meets the needs presented above by generally comprising a band that is wearable around a cuff of a boxing glove when the boxing glove is worn for boxing training. A strap is coupled to the band and the strap is matable to the band such that the band and the strap form a closed loop around the cuff of the boxing glove. A grip is coupled to the band and the grip is unrestrained when the band and strap are worn around the boxing glove. Thus, a trainee can manipulate the grip when the trainee is wearing boxing gloves. A flexible weight is positioned within the band for increasing a weight of the boxing glove thereby enhancing strength training and endurance training when the boxing glove is worn.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
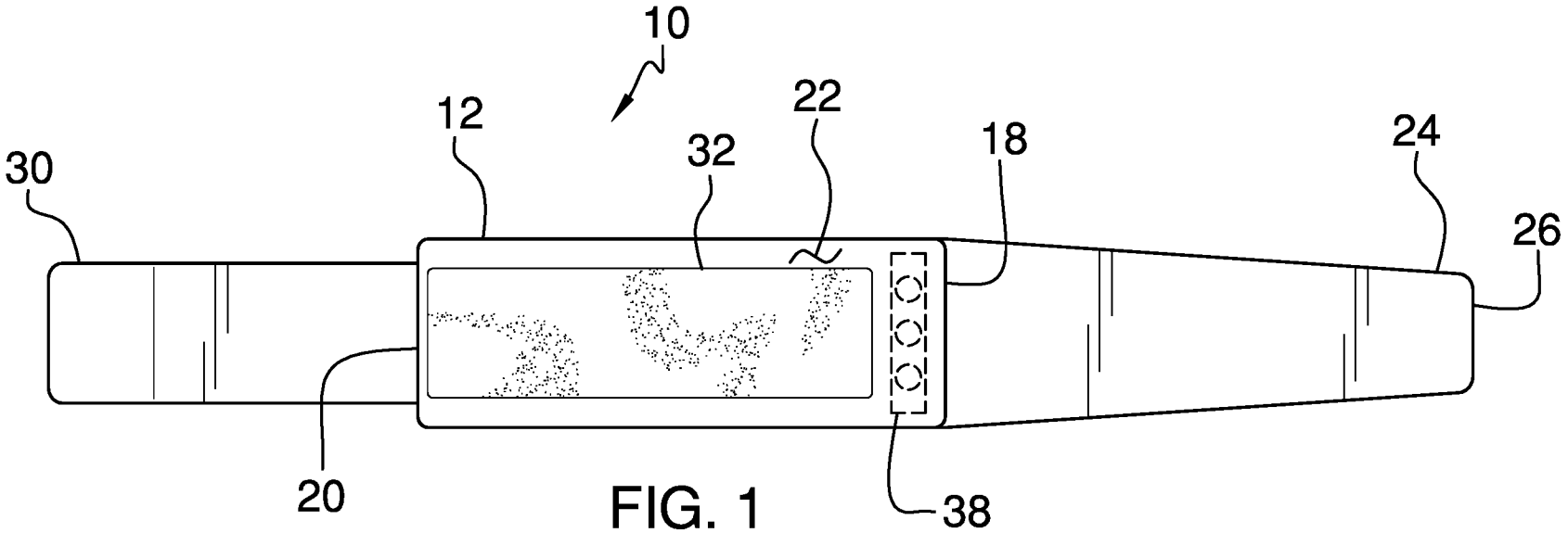
FIG. 1 is a top phantom view of a weighted wrist band assembly according to an embodiment of the disclosure.
Figure 2:
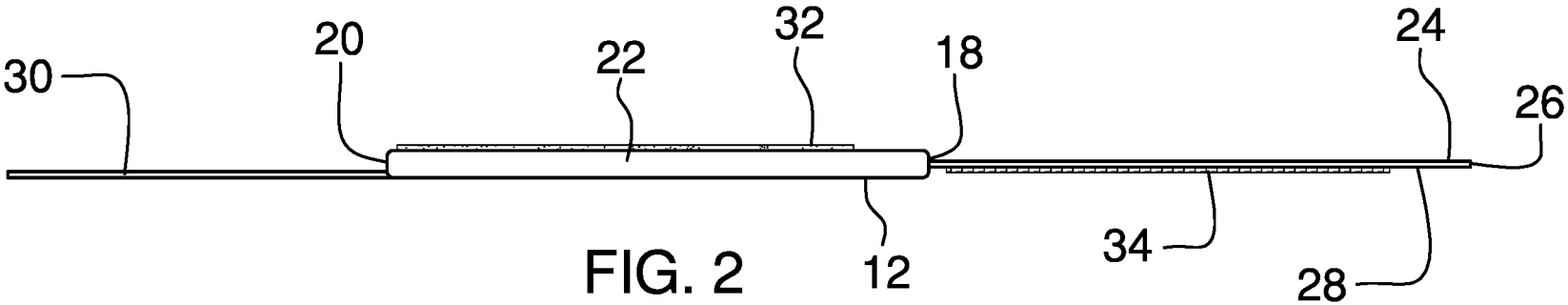
FIG. 2 is a right side view of an embodiment of the disclosure.
Figure 3:
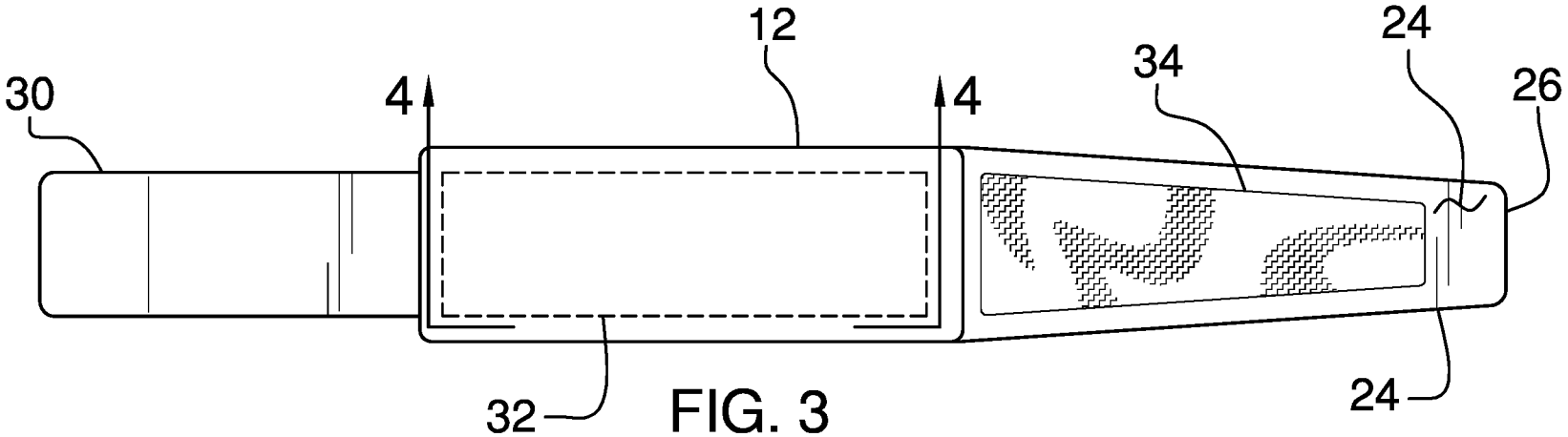
FIG. 3 is a bottom phantom view of an embodiment of the disclosure.
Figure 4:
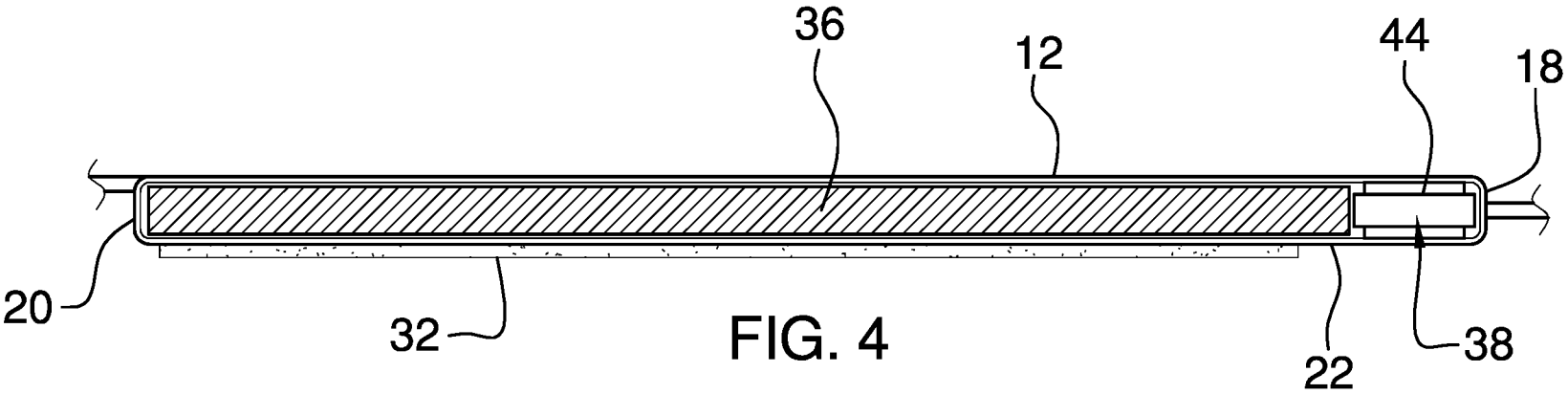
FIG. 4 is a cross sectional view taken along line 4-4 of FIG. 3 of an embodiment of the disclosure.
Figure 5:
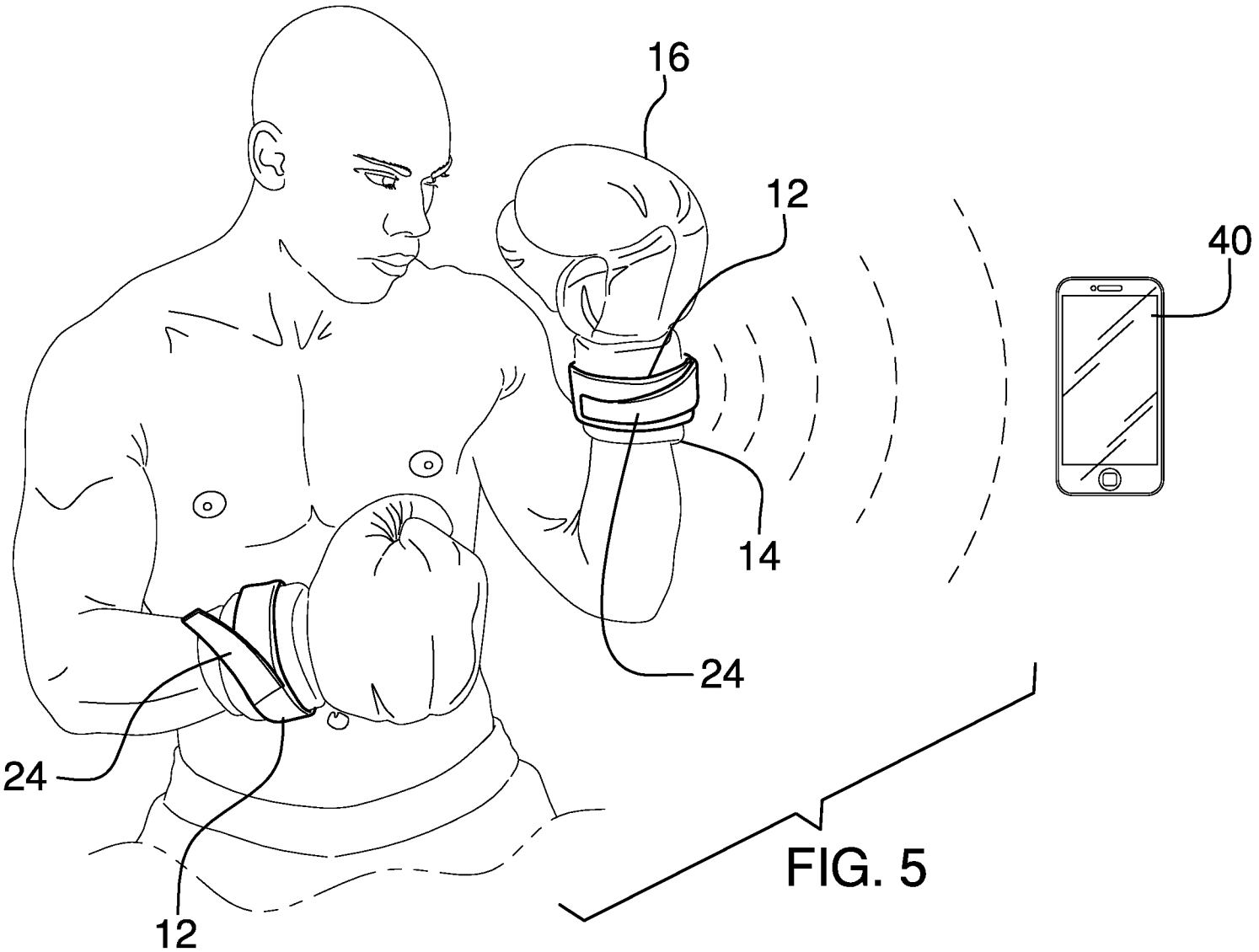
FIG. 5 is a perspective in-use view of an embodiment of the disclosure.
Figure 6:
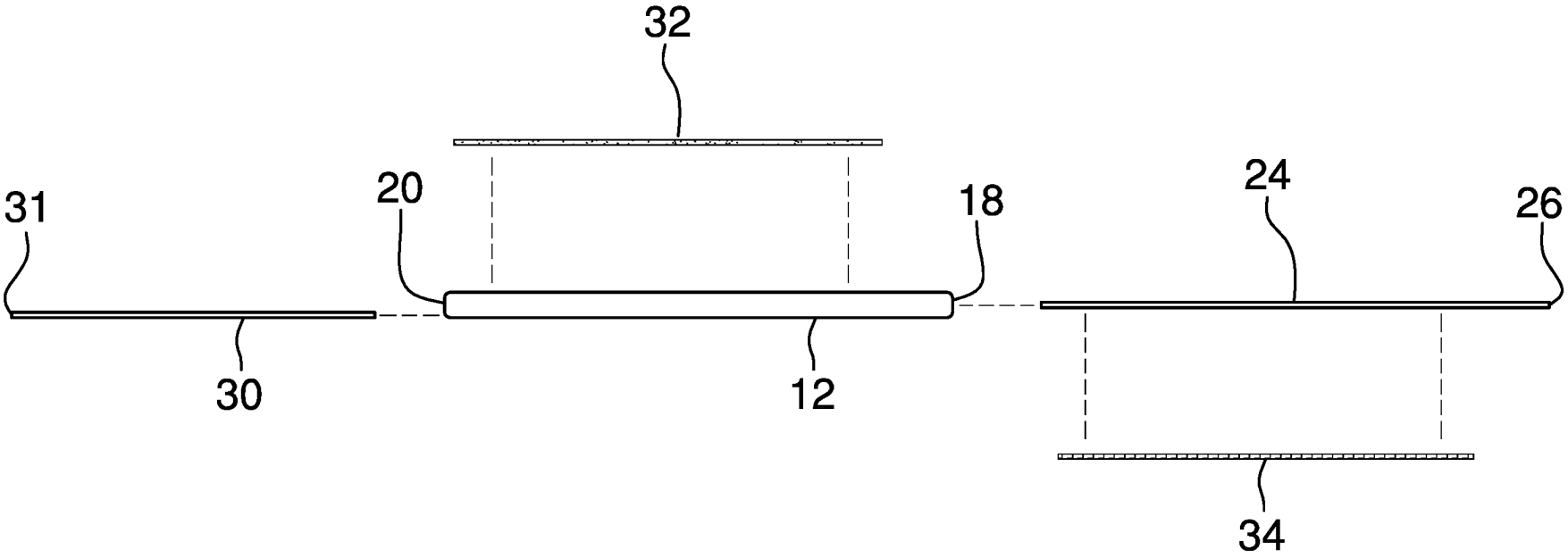
FIG. 6 is an exploded perspective view of an embodiment of the disclosure.
Figure 7:
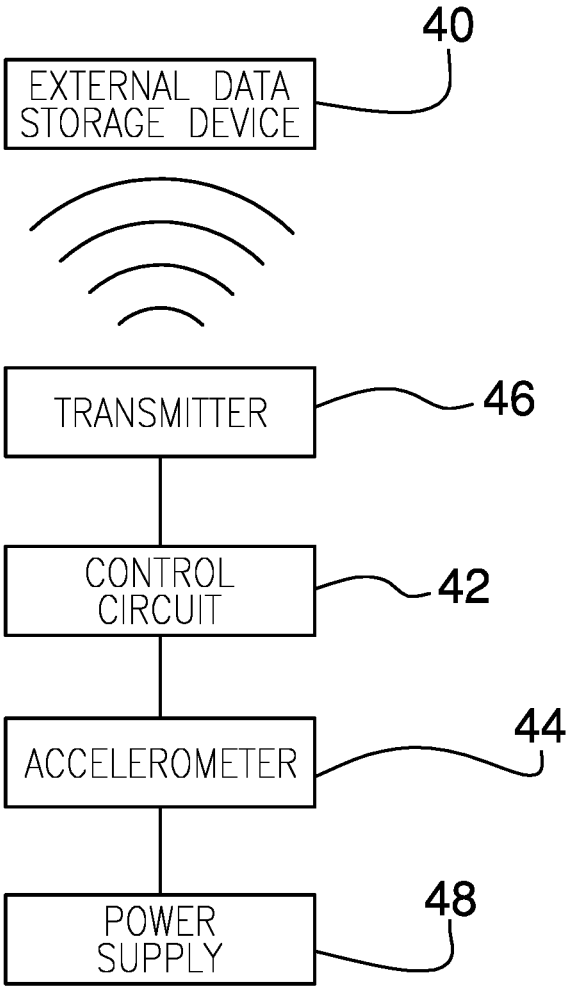
FIG. 7 is a schematic view of an embodiment of the disclosure.

With reference now to the drawings, and in particular to FIGS. 1 through 7 thereof, a new wrist band device embodying the principles and concepts of an embodiment of the disclosure and generally designated by the reference numeral 10 will be described.

As best illustrated in FIGS. 1 through 7, the weighted wrist band assembly 10 generally comprises a band 12 that is wearable around a cuff 14 of a boxing glove 16 when the boxing glove 16 is worn for boxing training. The boxing glove 16 may be a boxing glove of any conventional design and weight, including but not being limited to, boxing gloves with a weight ranging between 8.0 oz and 20.0 oz. Moreover, the boxing gloves may be training gloves employed during kickboxing training, boxing training and any other athletic activity involving repetitive motion of the arms. The band 12 has a first end 18, a second end 20 and a top surface 22 extending therebetween and the band 12 may have a length of approximately 10.0 inches and a width of approximately 4.75 inches.

A strap 24 is coupled to the band 12 and the strap 24 is matable to the band 12 such that the band 12 and the strap 24 form a closed loop around the cuff 14 of the boxing glove 16. The strap 24 is coupled to and extends away from the first end 18 of the band 12, and the strap 24 has a distal end 26 with respect to the first end 18 and a bottom surface 28. The strap 24 tapers between the first end 18 and the distal end 26 and the strap 24 may have a length of approximately 10.0 inches.

A grip 30 is coupled to and extends away from the second end 20 of the band 12, and the grip 30 has a distal end 31 with respect to the second end 20. The grip 30 may have a length of approximately 7.0 inches and a width that is less than the width of the band 12. A first mating member 32 is coupled to the band 12 and the first mating member 32 is positioned on the top surface 22 of the band 12. A second mating member 34 is coupled to the strap 24 and the second mating member 34 is positioned on the bottom surface 28 of the strap 24.

The second mating member 34 releasably engages the first mating member 32 to retain the strap 24 and the band 12 in the closed loop of a selected diameter. In this way the band 12 and the strap 24 can be worn around a variety of sizes of boxing gloves. Additionally, each of the first 32 and second 34 mating members may comprise complementary hook and loop fasteners. The grip 30 is unrestrained between the band 12 and the distal end 31 of the grip 30 when the band 12 and strap 24 are worn around the cuff 14 of the boxing glove 16. Thus, a trainee can manipulate the grip 30 while the trainee is wearing boxing gloves thereby facilitating the trainee to uncouple the first mating member 32 from the second member 34 and thusly remove the band 12 and the strap 24 from the boxing glove 16 without assistance.

A flexible weight 36 is positioned within the band 12 for increasing a weight of the boxing glove 16 thereby enhancing strength training and endurance training when the boxing glove 16 is worn. The flexible weight 36 may have a weight ranging between approximately 0.45 kg and 2.3 kg. Moreover, the flexible weight 36 is comprised of a flexible material to enhances comfort when the band 12 is worn. The flexible weight 36 may be comprised of Flex-Metal® as manufactured by Ironwear® Fitness in Pittsburgh, Pa.

A motion tracking unit 38 may be provided and the motion tracking unit 38 may be coupled to the band 12 for tracking motion of the band 12. The motion tracking unit 38 may be in communication with an external data storage device 40 for receiving motion data from the motion tracking unit 38. The external data storage device 40 may be a smart phone, a personal computer and any other electronic device with wireless communication capabilities. The motion tracking unit 38 may comprise a control circuit 42 that may coupled to the band 12 and may include an accelerometer 44 that may coupled to the band 12. The accelerometer 44 may electrically coupled to the control circuit 42 and the accelerometer 44 may detect acceleration and deceleration of the band 12 when the boxing glove 16 is worn for boxing training. The accelerometer 44 may be an electronic accelerometer 44 of any conventional design.

A transmitter 46 may be coupled to the band 12 and the transmitter 46 may electrically coupled to the control circuit 42. The transmitter 46 may be in wireless electrical communication with the external data storage device 40 to broadcast acceleration and deceleration data from the accelerometer 44 to the external data storage device 40 for subsequent analysis. The transmitter 46 may be a radio frequency transmitter or the like and the transmitter 46 may employ Bluetooth communication protocols. A power supply 48 may coupled to the band 12, the power supply 48 may be electrically coupled to the control circuit 42 and the power supply 48 may comprise at least one battery.

In use, the band 12 is worn around the cuff 14 of the boxing glove 16 during athletic training. The flexible weight 36 adds mass to the boxing glove 14 thereby increasing the physical exertion required during the athletic training. The grip 30 is unrestrained between the band 12 and the distal end 31 of the grip 30 when the band 12 and strap 24 are coupled around the cuff 14 of the boxing glove 12. Thus, the trainee can manipulate the grip 30 while the trainee is wearing boxing gloves, thereby facilitating the trainee to remove or adjust the band 12 and the strap 24 without assistance.

The accelerometer 44 may detect acceleration and deceleration of the boxing glove 16 during the athletic training, such as when the boxing glove 16 strikes a heavy bag or when the boxing glove 16 strikes an opponent during sparring. The transmitter 46 may continuously transmit the data from the accelerometer 44 to the external data storage device 40. Thus, the data from the accelerometer 44 may be subsequently analyzed for determining strengths and weaknesses in the trainee's training routine.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A weighted wrist band assembly comprising:

a band, said band being elongated;

a strap being coupled to said band, said strap being matable to said band, said strap being elongated and aligned with said band such that said band and said strap form a closed loop configured for positioning around a cuff of a boxing glove;

a grip being coupled to said band, said grip being unrestrained when said band and said strap are coupled around the cuff such that said grip can be manipulated by a trainee to disengage said strap from said band without assistance when the trainee is wearing boxing gloves; and a flexible weight being positioned within said band for increasing a weight of the boxing glove wherein said band is configured to enhance strength training and endurance training, said flexible weight having a weight ranging between approximately 0.45 kg and 2.3 kg, said flexible weight being comprised of a flexible material.

2. The assembly according to claim 1, wherein:

said band has a first end, a second end and a top surface extending therebetween;

said strap is coupled to and extends away from said first end of said band, said strap having a distal end with respect to said first end and a bottom surface, said strap tapering between said first end and said distal end.

3. The assembly according to claim 2, wherein said grip extends away from said second end of said band, said grip having a distal end with respect to said second end, said grip being unrestrained between said band and said distal end of said grip when said band and said strap are worn around said cuff of said boxing glove such that said grip can be manipulated by a trainee wearing boxing gloves wherein said grip is configured to facilitate the trainee to remove said band and said strap from said boxing glove without assistance.

4. The assembly according to claim 2, further comprising:

a first mating member being coupled to said band, said first mating member being positioned on said top surface of said band; and a second mating member being coupled to said strap, said second mating member releasably engaging said first mating member to retain said strap and said band in said closed loop having a selected diameter.

5. The assembly according to claim 1, further comprising:

a motion tracking unit coupled to said band, said motion tracking unit comprising a control circuit coupled to said band, an accelerometer electrically coupled to said control circuit, and a transmitter coupled to said band and operationally coupled to said control circuit wherein said control circuit is configured to transmit acceleration and deceleration data from said accelerometer to an external data storage device.

6. A weighted wrist band assembly being configured to be worn during athletic training for increasing strength and stamina in an athlete's arms, said assembly comprising:

a band, said band being elongated, said band having a first end, a second end and a top surface extending therebetween;

a strap being coupled to said band, said strap being matable to said band, said strap being elongated and aligned with said band such that said band and said strap form a closed loop configured for positioning around a cuff of a boxing glove, said strap being coupled to and extending away from said first end of said band, said strap having a distal end with respect to said first end and a bottom surface, said strap tapering between said first end and said distal end;

a grip being coupled to and extending away from said second end of said band, said grip having a distal end with respect to said second end, said grip being unrestrained between said band and said distal end of said grip when said band and said strap are worn around said cuff of said boxing glove such that said grip can be manipulated by a trainee wearing boxing gloves wherein said grip is configured to facilitate the trainee to remove said band and said strap from said boxing glove without assistance;

a first mating member being coupled to said band, said first mating member being positioned on said top surface of said band;

a second mating member being coupled to said strap, said second mating member releasably engaging said first mating member to retain said strap and said band in said closed loop having a selected diameter; and a flexible weight being positioned within said band for increasing a weight of the boxing glove wherein said band is configured to enhance strength training and endurance training, said flexible weight having a weight ranging between approximately 0.45 kg and 2.3 kg, said flexible weight being comprised of a flexible material.

7. The assembly according to claim 6, further comprising:

a motion tracking unit coupled to said band, said motion tracking unit comprising a control circuit coupled to said band, an accelerometer electrically coupled to said control circuit, and a transmitter coupled to said band and operationally coupled to said control circuit wherein said control circuit is configured to transmit acceleration and deceleration data from said accelerometer to an external data storage device.

* * * * *